US007762242B2

(12) United States Patent
Gates et al.

(10) Patent No.: US 7,762,242 B2
(45) Date of Patent: Jul. 27, 2010

(54) EXHAUST GAS RECIRCULATION VALVE

(75) Inventors: Freeman Carter Gates, Bloomfield Hills, MI (US); Sassan Farahmand, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 145 days.

(21) Appl. No.: 12/134,275

(22) Filed: Jun. 6, 2008

(65) Prior Publication Data

US 2009/0301447 A1 Dec. 10, 2009

(51) Int. Cl.
*F02B 47/08* (2006.01)
*F02B 47/00* (2006.01)

(52) U.S. Cl. ..... 123/568.18

(58) Field of Classification Search ..... 123/568.18, 123/568.17, 568.19, 568.14; 701/108
See application file for complete search history.

(56) References Cited

U.S. PATENT DOCUMENTS

| | | | | |
|---|---|---|---|---|
| 3,820,514 | A * | 6/1974 | Kuehl | 123/568.18 |
| 4,329,965 | A * | 5/1982 | Ueda et al. | 123/568.18 |
| 4,401,092 | A | 8/1983 | Rachedi | |
| 4,881,509 | A | 11/1989 | Ohashi et al. | |
| 5,482,020 | A | 1/1996 | Shimizu et al. | |
| 5,722,634 | A | 3/1998 | Hrytzak et al. | |
| 6,253,749 | B1 | 7/2001 | Kotwicki et al. | |
| 6,484,705 | B2 * | 11/2002 | Bircann et al. | 123/568.18 |
| 6,655,345 | B2 | 12/2003 | Ogawa et al. | |
| 6,749,174 | B2 | 6/2004 | Bircann et al. | |
| 7,000,380 | B2 | 2/2006 | Tokuyasu et al. | |
| 7,066,158 | B2 | 6/2006 | Kuzuyama | |
| 7,069,901 | B2 | 7/2006 | Shiraishi et al. | |
| 7,128,051 | B2 | 10/2006 | Nogi et al. | |
| 2003/0006390 | A1 * | 1/2003 | Smith et al. | 251/129.15 |
| 2003/0192518 | A1 * | 10/2003 | Gopp et al. | 123/568.21 |

FOREIGN PATENT DOCUMENTS

JP 404175449 A 6/1992

* cited by examiner

*Primary Examiner*—Mahmoud Gimie
(74) *Attorney, Agent, or Firm*—Julia Voutyras; Brooks Kushman P.C.

(57) ABSTRACT

A system and method for controlling a multiple cylinder internal combustion engine include a mechanically operated exhaust gas recirculation valve having a spring-biased pintle with a surface area sized to generate a spring-opposing force to open a valve chamber entrance when an exhaust pressure differential exceeds a first threshold to allow exhaust gas to flow toward an intake and to close a valve chamber exit spaced from the chamber entrance to block exhaust gas flowing to the intake when the pressure differential exceeds a second threshold. The valve operates to limit or block external EGR flow at low load such as during starting and idle as well as at wide-open throttle while metering EGR flow for mid-to-high loads.

20 Claims, 3 Drawing Sheets

EXHAUST GAS RECIRCULATION VALVE

BACKGROUND

1. Technical Field

The present disclosure relates to a system and method for controlling exhaust gas recirculation (EGR) for an internal combustion engine using a pintle-type EGR valve.

2. Background Art

Exhaust gas recirculation (EGR) is a well-known engine control strategy that uses a controllable amount of exhaust gas during a subsequent combustion cycle to improve fuel economy and manage emissions. EGR may include internal EGR, or exhaust gas that remains in the cylinders after combustion, and external EGR, which is routed through a pipe or tube from the exhaust back to the intake. The amount of internal EGR can be varied by controlling the open/close timing of the intake and/or exhaust valves. Depending on the particular implementation of the intake and/or exhaust valve control, desired EGR flow may be difficult to obtain under some operating conditions, such as mid-to-high speeds and loads. External EGR is usually controlled by a flow control valve that may be electrically, pneumatically (using vacuum), and/or mechanically actuated. Solenoid-type, stepper motor and DC motor EGR valves are controlled by an electrical signal generated by the engine/vehicle controller and provide the greatest control flexibility, but are considerably more expensive and may require additional development and calibration time than mechanically or pneumatically actuated valves. Mechanically or pneumatically actuated valves that include a diaphragm typically have temperature constraints that require them to be positioned away from the exhaust manifold and connected using an additional pipe or tube.

SUMMARY

A system and method for controlling a multiple cylinder internal combustion engine include a mechanically operated exhaust gas recirculation valve having a spring biased pintle with a surface area sized to generate a spring-opposing force to open a valve chamber entrance when an exhaust pressure differential exceeds a first threshold to allow exhaust gas to flow toward an intake and to close a valve chamber exit spaced from the chamber entrance to block exhaust gas flowing to the intake when the pressure differential exceeds a second threshold.

In one embodiment, internal exhaust gas recirculation is provided using variable cam timing for intake and/or exhaust valves with external exhaust gas recirculation provided using mechanical pintle-valve mounted directly to the exhaust manifold. In this embodiment, the valve includes a dual pintle that includes a first valve land having a first surface area held closed against the valve chamber entrance by the spring force when the exhaust pressure differential is below the first threshold, such as when the engine is idling or under low-load conditions, and a second valve land spaced from the first valve land and having a second surface area that moves against the spring force to close the valve chamber exit when the exhaust pressure differential exceeds the second threshold, such as at wide-open throttle (WOT). One embodiment includes a second or supplementary pintle biased by a second spring force and actuated by intake vacuum to close against the second spring force to prevent exhaust gas from flowing toward the intake under low load conditions, including engine starting and idle.

One embodiment of a method for controlling an internal combustion engine having an exhaust gas recirculation valve includes biasing a first pintle against a chamber opening to prevent exhaust gas flow to an intake until exhaust differential pressure exceeds a first threshold and moving a second pintle against the bias to close a chamber exit and prevent exhaust gas flow to the intake when exhaust differential pressure exceeds a second threshold.

The present disclosure includes embodiments having various advantages. For example, embodiments of the present disclosure provide a relatively simple and cost effective strategy for improving fuel economy and managing emissions. In particular, a pintle-type EGR valve according to the present disclosure operates based on exhaust pressure differential rather than a signal from the engine/vehicle controller to open and meter EGR flow for mid-to-high loads while closing to stop EGR flow under low-load conditions and also at WOT. Limiting external EGR at WOT provides enhanced performance where fuel economy is compromised to provide maximum power. The addition of external EGR with a pintle-type mechanical EGR valve may improve knock/pre-ignition robustness to enhance performance and fuel economy while effectively managing emissions. Use of a pintle-type valve without a diaphragm eliminates diaphragm-related temperature constraints such that the EGR valve can be mounted directly to the exhaust manifold, thereby eliminating any connecting tube or pipe between the exhaust manifold and the valve. The use of a pressure-controlled mechanical valve does not require additional engine control software programming and calibration, while still providing desired control characteristics to prevent EGR flow during engine starting, low-load operation, and WOT operation.

The above advantages and other advantages and features will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a spark-ignition multiple-cylinder internal combustion engine having a variable cam timing system that allows control of internal EGR by changing valve timing of intake and exhaust valves. Those of ordinary skill in the art may recognize similar applications or implementations consistent with the present disclosure for other engine technologies, including compression-ignition engines of various configurations that may include variable cam timing for only intake valves or only exhaust valves, or that use other strategies to vary valve timing, for example.

Figure 1:
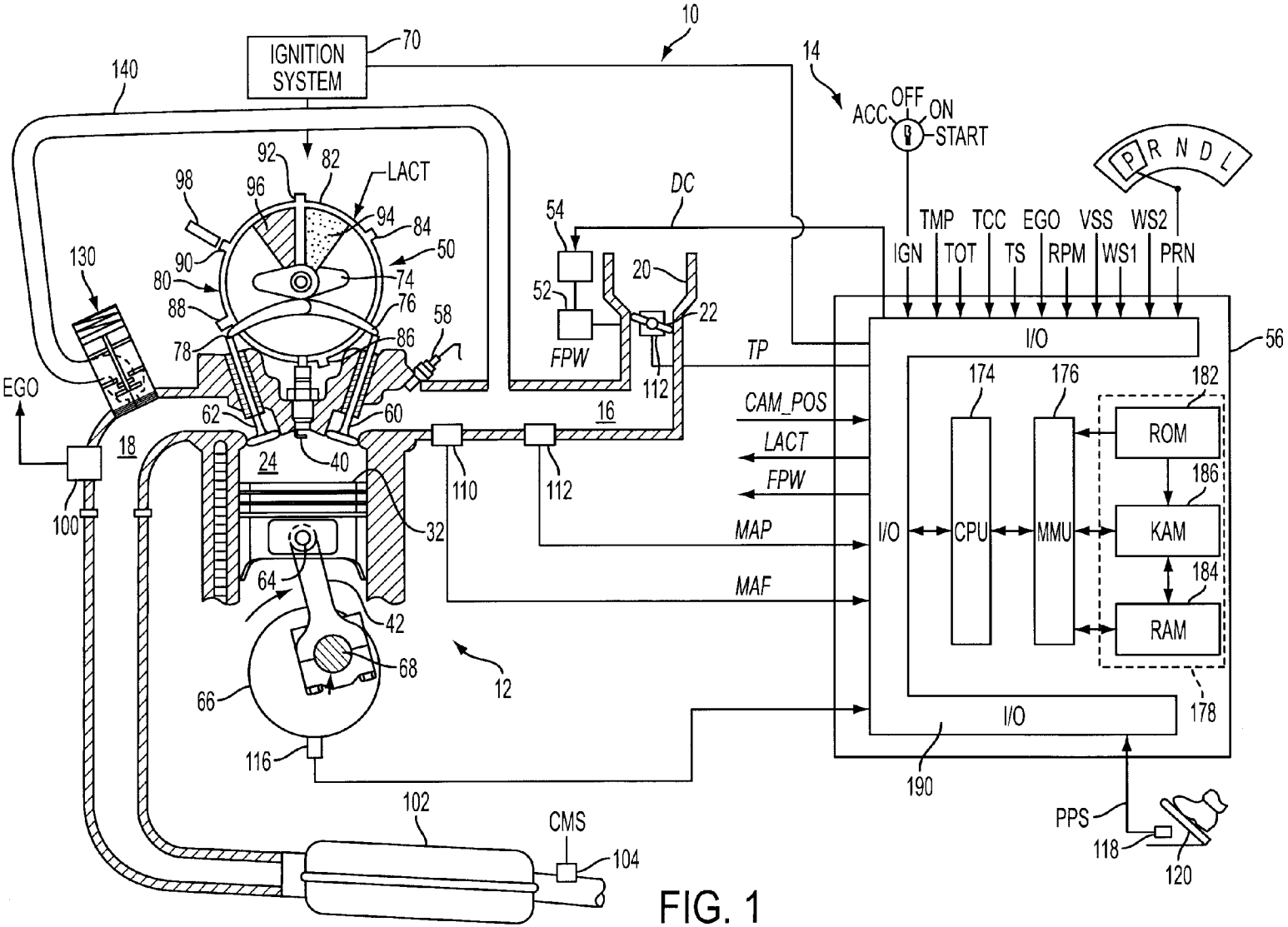
FIG. 1 is a block diagram illustrating operation of a system or method for controlling exhaust gas recirculation (EGR) with internal and external EGR according to embodiments of the present disclosure.

Referring now to FIG. 1, a vehicle 10 includes a multiple cylinder internal combustion engine 12 and an associated engine control system 14. As illustrated, engine control system 14 is in communication with various sensors and actuators. Engine 12 includes an intake manifold 16, an exhaust manifold 18, a throttle body 20, a throttle plate 22, multiple cylinders represented by cylinder 24 with corresponding pistons contained therein as represented by piston 32 and associated spark plugs as represented by spark plug 40, connecting rod assemblies represented by assembly 42, and variable cam timing (VCT) mechanism 50.

In operation, intake manifold 16 is coupled to throttle body 20 with intake air modulated via electronically controlled throttle plate 22. Throttle plate 22 is controlled by electric motor 52 in response to a signal received from ETC driver 54 based on a corresponding control signal (DC) received from a controller 56 generated in response to a requested torque or power via position of accelerator pedal 120 as determined by pedal position sensor 118. A throttle plate position sensor 112 provides a feedback signal (TP) for closed loop control of throttle plate 22. Air inducted into throttle body 20 passes through intake manifold 16 past mass airflow sensor 110, which provides a corresponding signal (MAF) indicative of the mass airflow to controller 56 for use in controlling the engine/vehicle. A manifold absolute pressure (MAP) sensor 112 may alternatively (or in combination) provide a signal indicative to the manifold pressure for use in controlling the engine/vehicle. In addition, controller 56 may communicate with various other sensors to monitor engine operating conditions, such as crankshaft position sensor 116, which may be used to determine engine rotational speed and to identify cylinder combustion based on an absolute, relative, or differential engine rotation speed.

An exhaust gas oxygen sensor 100 provides a signal (EGO) to controller 56 indicative of whether the exhaust gases are lean or rich of stoichiometry. Depending upon the particular application, sensor 100 may provide a two-state signal corresponding to a rich or lean condition, or alternatively a signal that is proportional to the stoichiometry of the exhaust gases. This signal may be used to adjust the air/fuel ratio, or control the operating mode of one or more cylinders, for example. The exhaust gas is passed through the exhaust manifold and one or more catalysts 102 before being exhausted to atmosphere. An additional EGO sensor 104 may be positioned downstream of the catalyst(s) 102 and provide a corresponding catalyst monitor signal (CMS) to controller 56 used to monitor performance of catalyst(s) 102.

Each cylinder 24 communicates with intake manifold 16 and exhaust manifold 18 via one or more respective intake and exhaust valves represented by intake valve 60 and exhaust valve 62. Cylinder 24 includes a combustion chamber having an associated reciprocating piston 32 operably disposed therein. Piston 32 is connected to connecting rod assembly 42 via a wrist pin 64. Connecting rod 42 is further coupled to crankshaft 66 via a crankpin 68. Ignition timing for ignition of an air-fuel mixture within cylinder 24 is controlled via spark plug 40, which delivers an ignition spark responsive to a signal from distributorless ignition system 70. As well known in the art, ignition timing is typically measured in degrees based on angular position of crankshaft 66 relative to a position corresponding to top dead center (TDC), i.e. the highest point of piston 32 within cylinder 24. For the port fuel injection engine illustrated, intake manifold 16 includes a fuel injector 58 coupled thereto for delivering fuel in proportion to the pulse width of one or more signals (FPW) from controller 56. Fuel is delivered to fuel injector 58 by a conventional fuel system (not shown) including a fuel tank, fuel pump, and fuel rail, for example.

As also shown in FIG. 1, engine 12 may include a variable cam timing (VCT) device or mechanism 50 to vary the actuation time of intake and exhaust valves 60, 62 for each cylinder 24. While the representative embodiment illustrated includes a VCT device 50 that operates to vary actuation time of both intake and exhaust valves, other applications or implementations may operate to vary the timing of only the intake valves 60 or only the exhaust valves 62. The VCT device 50 may be used to control the amount of residual gases remaining in cylinder 24, also referred to as internal EGR, to enhance fuel economy and manage emissions. However, control of internal EGR is generally limited to low speed/load operating conditions. As such, system 10 includes a mechanical EGR valve 130 which is not controlled by engine/vehicle controller 56 and is disposed between engine exhaust manifold 18 and intake manifold 16. As described in greater detail herein, EGR valve 130 is a pintle-type flow control valve that can be mounted directly to exhaust manifold 18 because it does not contain a diaphragm, which would typically require valve 130 to be spaced from the exhaust manifold due to diaphragm temperature limitations. EGR valve 130 is actuated by a pressure differential across one or more pintles to open when the exhaust pressure differential exceeds a first threshold to allow exhaust gas to flow from exhaust manifold 18 through EGR pipe or tube 140 to intake manifold 16. EGR valve 130 also operates to block external EGR under low speed-load operating conditions, such as during engine starting and idle, when the pressure differential is below the first threshold to control flow in the mid-to-high speed-load range as illustrated and described with reference FIG. 4. EGR valve 130 also blocks external EGR flow when throttle plate 112 is moved to a wide-open position (WOT) resulting in the exhaust pressure differential exceeding a second threshold to provide maximum power.

VCT mechanism 50 cooperates with corresponding lobes of a camshaft 74, which are shown communicating with rocker arms 76, 78 for variably actuating valves 60, 62. Camshaft 74 is directly coupled to housing 80, which forms a toothed cam wheel 82 having teeth 84, 86, 88, 90, 92. Housing 80 is hydraulically coupled to an inner shaft (not shown), which is in turn directly linked to camshaft 74 via a timing chain (not shown). Therefore, housing 80 and camshaft 74 rotate at a speed substantially equivalent to the inner camshaft. The inner camshaft rotates at a constant speed ratio relative to crankshaft 66. The position of camshaft 74 relative to crankshaft 66 can be varied by hydraulic pressure in advance chamber 94 and/or retard chamber 96. By allowing high-pressure hydraulic fluid to enter advance chamber 94, the relative relationship between camshaft 74 and crankshaft 66 is advanced. Thus, intake valve 60 and exhaust valve 62 open and close at a time earlier than normal relative to crankshaft 66. Similarly, by allowing high-pressure hydraulic fluid to enter retard chamber 96, the relative relationship between camshaft 74 and crankshaft 66 is retarded. Thus, intake valve 60 and exhaust valve 62 open and close at a time later than normal relative to crankshaft 66.

Teeth 84, 86, 88, 92 of cam wheel 82 are coupled to housing 80 and camshaft 74 and allow for measurement of relative position of camshaft 74 via cam timing sensor 98 which provides signal CAM_POS to controller 56. Tooth 90 is used for cylinder identification. As illustrated, teeth 84, 86, 88, 92 may be evenly spaced around the perimeter of cam wheel 82. Controller 56 sends control signal LACT to a conventional solenoid spool valve (not shown) to control the flow of hydraulic fluid into either advance chamber 94, retard chamber 96, or neither. Relative position of camshaft 74 can be measured in general terms, using the time, or rotation angle between the rising edge of a PIP signal and receiving a signal from one of teeth 84, 86, 88, 90, or 92 as is known.

Controller 56 has a microprocessor 174, also referred to as a central processing unit (CPU), in communication with memory management unit (MMU) 176. MMU 176 controls the movement of data among the various computer readable storage media 178 and communicates data to and from CPU 174. Computer readable storage media 178 preferably include volatile and nonvolatile storage in read-only memory (ROM) 182, random-access memory (RAM) 184, and keep-alive memory (KAM) 186, for example. KAM 186 may be used to store various operating variables or control system parameter values while CPU 184 is powered down. Computer-readable storage media 178 may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions or code, used by CPU 174 in controlling the engine or vehicle into which the engine is mounted and for performing on-board diagnostic (OBD) monitoring of various engine/vehicle features. Computer-readable storage media 178 may also include floppy disks, CD-ROMs, hard disks, and the like.

CPU 24 communicates with various engine/vehicle sensors and actuators via an input/output (I/O) interface 190 that may be implemented as a single integrated interface providing various raw data or signal conditioning, processing, and/or conversion, short-circuit protection, and the like. Alternatively, one or more dedicated hardware or firmware chips may be used to condition and process particular signals before being supplied to CPU 174. Examples of items that may be directly or indirectly actuated under control of CPU 174, through I/O interface 190, are fuel injection timing, rate, and duration, throttle valve position, spark plug ignition timing (for spark-ignition engines), intake/exhaust valve timing and/or duration, front-end accessory drive (FEAD) components such as an alternator, air conditioning compressor, and the like. Sensors communicating input through I/O interface 190 may be used to indicate crankshaft position (PIP), engine rotational speed (RPM), wheel speed (WS1, WS2), vehicle speed (VSS), coolant temperature (ECT), accelerator pedal position (PPS), ignition switch position (IGN), throttle valve position (TP), air temperature (TMP), exhaust gas oxygen (EGO) or other exhaust gas component concentration or presence, intake air flow (MAF), transmission gear or ratio (PRN), transmission oil temperature (TOT), transmission turbine speed (TS), torque converter clutch status (TCC), or catalytic converter performance (CMS), for example.

Some controller architectures do not contain an MMU 176. If no MMU 176 is employed, CPU 174 manages data and connects directly to ROM 182, RAM 184, and KAM 186. Of course, more than one CPU 174 may be used to provide engine control and diagnostics and controller 56 may contain multiple ROM 182, RAM 184, and KAM 186 coupled to MMU 176 or CPU 174 depending upon the particular application.

Controller 56 includes software and/or hardware implementing control logic to coordinate control of internal exhaust gas recirculation with external exhaust gas recirculation controlled by mechanical EGR valve 130, which operates without a control signal from controller 56, to provide desired performance, fuel economy, and emissions management under various operating conditions. Controller 56 provides control signals to VCT device 50 to alter timing of gas exchange valves 60 and/or 62 to control internal EGR. EGR valve 130 includes a spring-biased pintle (FIGS. 2-3) that opens a valve entrance when an exhaust pressure differential exceeds a first threshold to allow exhaust gas to flow from exhaust manifold 18 to intake manifold 16 and closes a valve exit when exhaust differential pressure exceeds a second threshold to substantially stop exhaust gas flow from the exhaust manifold 18 to intake manifold 16.

Figure 2:
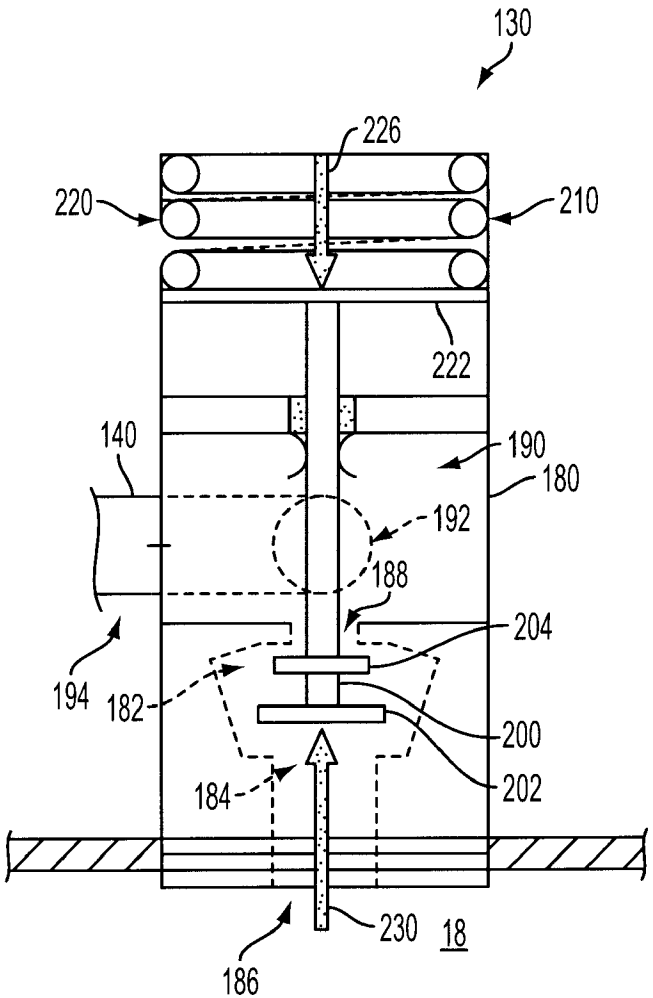
FIG. 2 illustrates a dual-pintle EGR valve for controlling external EGR flow according to one embodiment of the present disclosure.
Figure 4:
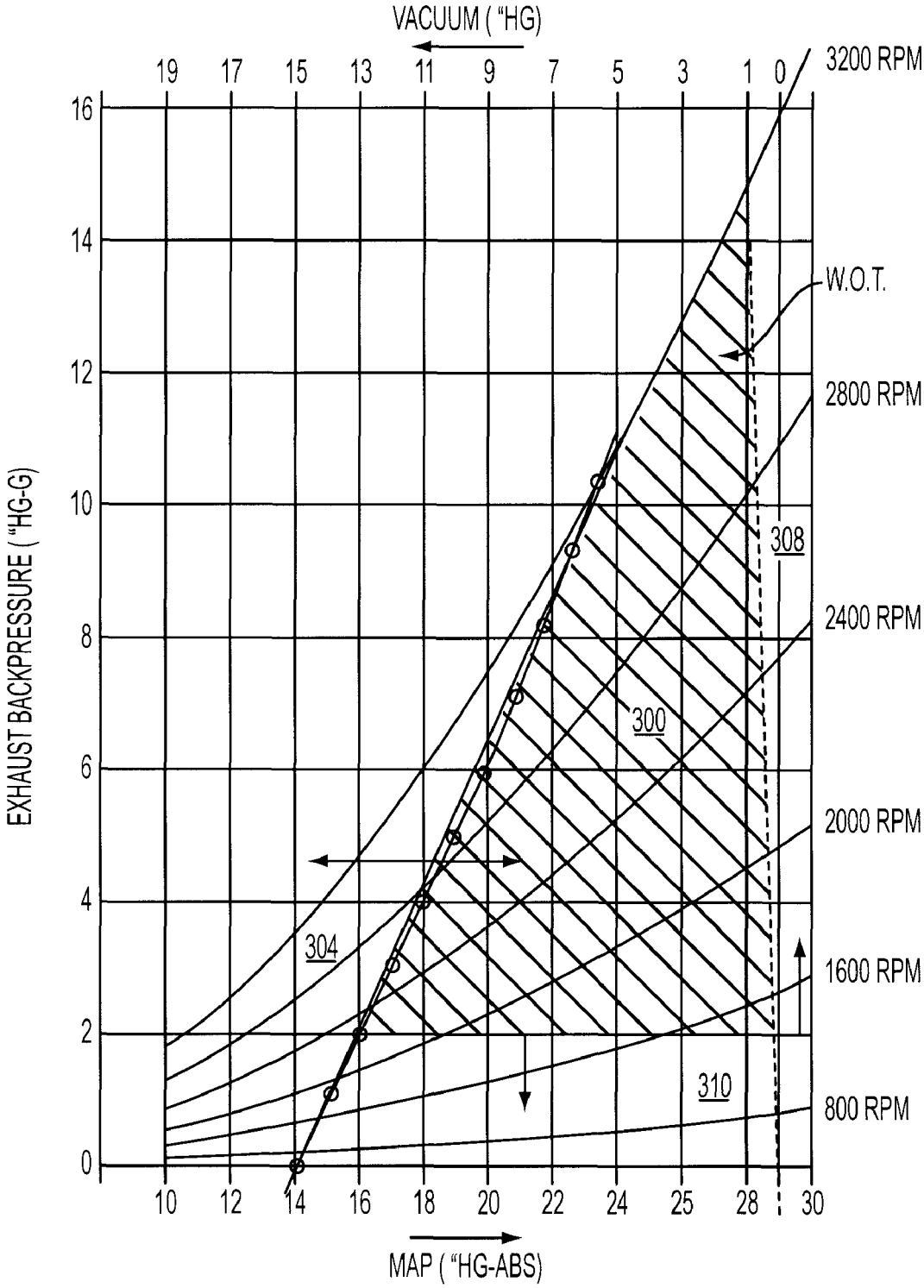
FIG. 4 is a graph illustrating operation of a system or method for controlling external EGR flow with a mechanical valve that blocks EGR flow at low load and WOT according to embodiments of the present disclosure.

FIG. 2 is a diagram illustrating a representative embodiment of a mechanical pintle-type EGR valve according to the present disclosure. Valve 130 has a housing 180 having a first chamber 182 with an entrance 184 for direct coupling to exhaust manifold 18 via valve entrance 186 and an exit 188 coupled to a second chamber 190 having an exit 192 coupled to a valve exit 194. A dual pintle 200 moves within first chamber 182 between a first position (not shown) with a first surface or valve land 202 sealing against the first chamber entrance 184 to block exhaust flow from entering first chamber 182, a second position (shown) having first surface 202 spaced from entrance 184 and a second surface or valve land 204 spaced from the first chamber exit 188 to allow exhaust flow through first chamber 182 and second chamber 190 to valve exit 194, and a third position (not shown) having second surface 204 sealing against first chamber exit 188 to prevent exhaust flow from leaving first chamber 182. As such, dual pintle 200 blocks substantially all external EGR flow from exhaust manifold 18 when dual pintle 200 is in the first and third positions. In the second position as pintle 200 moves between the first and third positions, pintle 200 cooperates with chamber 182 to meter or control the rate of EGR flow depending on the actual position of surfaces 202, 204 relative to entrance 184 and exit 188, respectively. In the illustrated embodiment, chamber 182 has a shape to facilitate desired EGR flow for mid-to-high speed-load operating conditions as illustrated in the graph of FIG. 4. Various other shapes for chamber 182 and surfaces 202, 204 may be provided depending upon the particular application and implementation.

As also shown in FIG. 2, EGR valve 130 includes a biasing device 210 contacting dual pintle 200 to bias first surface 202 toward first chamber entrance 184. In the representative embodiment illustrated, biasing device 210 is implemented by a coil spring disposed between housing 180 and dual pintle 200 to bias dual pintle 200 toward chamber entrance 184 and away from chamber exit 188. Various other types of biasing devices may be used alone or in combination with one or more springs to provide a desired force vs. travel profile in response to an exhaust pressure differential or delta pressure across dual pintle 200. For example, other types of springs may be used, two or more springs may provide a multi-rate profile, or a spring may be used in combination with a pneumatic, hydraulic, or other device to provide a desired profile. Housing 180 may include one or more vents 220 to atmosphere to equalize pressure across plunger 222 as it moves within housing 180.

In operation, biasing device 210 exerts a biasing force represented by arrow 226 on pintle 200 to seal surface 202 against entrance 184 and block EGR flow when differential exhaust pressure, also referred to as exhaust back pressure, is below a first threshold associated with low speed-load operation (FIG. 4), which includes but is not limited to engine starting and idle. When exhaust back pressure, represented by arrow 230, exceeds a first threshold, back pressure 230 acting on surface area 202 generates a force sufficient to overcome biasing force 226 to move surface 202 away from entrance 184 to allow EGR flow through chamber 182 to valve exit 194. As back pressure 230 increases and exceeds a second threshold, the force of back pressure 230 acting on surface areas 202 and the opposite side of surface 204 moves pintle 200 into the third position with surface 204 sealing against chamber exit 188 to block EGR flow from exiting chamber 182. Preferably, the second threshold corresponds to wide-open throttle (WOT) operation so that EGR flow is substantially stopped to provide maximum available power at WOT. One or more calibration devices 250, 252 (FIG. 3) may be provided to calibrate the first and second threshold values by adjusting spring pre-load of biasing device 210.

In the representative embodiment of FIG. 2, dual pintle 200 includes a second valve land or pintle spaced from the first valve land or pintle to provide a desired effective surface area and corresponding force profile for the exhaust back pressure of a representative application with the upper surface 204 of the second land sealing against chamber exit 188 and the lower surface 202 of the first land sealing against chamber entrance 184. However, a single pintle or land could be provided with an upper surface 204 and lower surface 202 on the same pintle or valve land depending upon the particular application and implementation.

Figure 3:
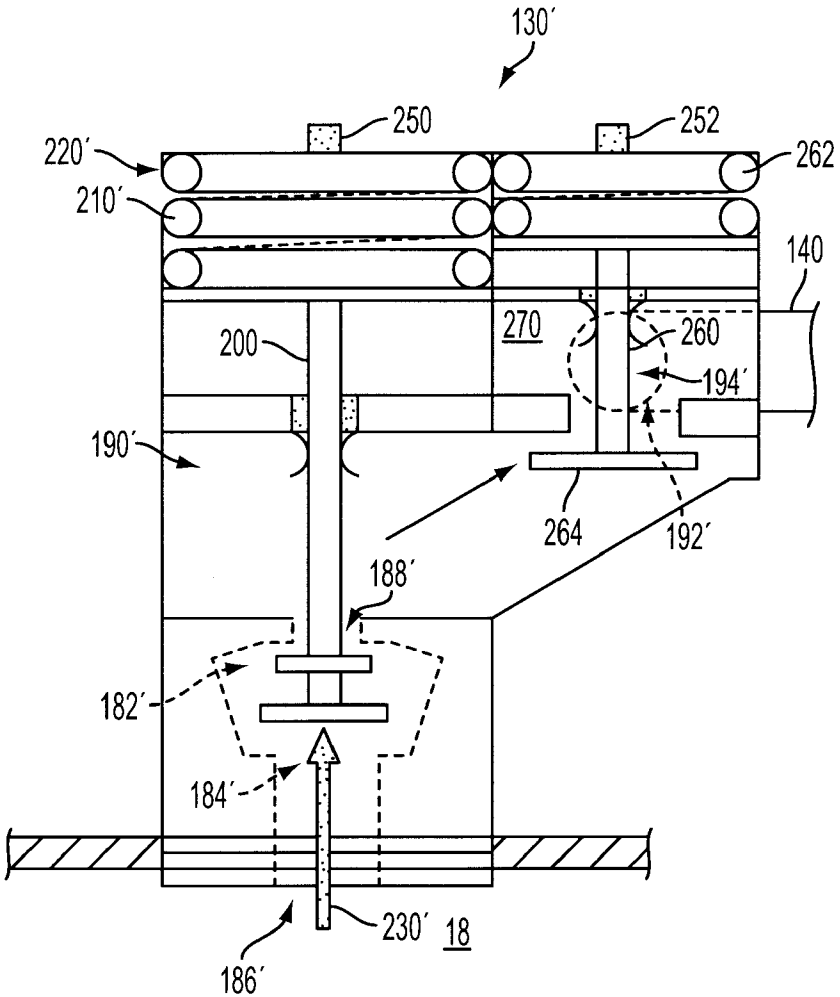
FIG. 3 illustrates a dual-pintle EGR valve with a supplemental vacuum-actuated pintle for controlling external EGR flow according to one embodiment of the present disclosure.

FIG. 3 illustrates another representative embodiment of a pintle-type EGR valve 130' according to the present disclosure. Primed reference numerals (such as 130'), identify components that are similar in structure and function to corresponding unprimed numerals (such as 130) that have been previously described with any significant exceptions noted. Valve 130' includes a dual pintle 200 moving within first chamber 182' and a second or supplementary pintle 260 moving within second chamber 190'. Second pintle 260 operates to prevent exhaust pintle 200 from opening during low load (high vacuum) operating conditions. Second pintle 260 selectively seals against second chamber exit 192' to block exhaust gas flow exiting second chamber 190' when the vacuum is above a corresponding threshold, which generally corresponds to the exhaust pressure differential being below a corresponding threshold. A second biasing device 262, implemented by a coil spring in this embodiment, provides a biasing force on pintle 260 to move land 274 away from second chamber exit 192'. Second chamber 190' is coupled to engine intake 16 (FIG. 1) via third chamber 270 and EGR tube or pipe 140 such that intake vacuum acts on land 264 to move pintle 260 against the biasing force of biasing device 262 to close second chamber exit 192' and stop exhaust gas flow when intake vacuum exceeds a corresponding threshold based on the size of exit 192' and the surface area of land 264.

In operation, when exhaust back pressure is below a first threshold and intake vacuum is above a first threshold, biasing device 220' holds pintle 200 in a closed position to block EGR flow. Likewise, intake vacuum acting on land 264 operates against biasing device 262 to move pintle 260 to a closed position sealing exit 192'. Some applications may require the supplemental pintle 260 to prevent EGR flow under low load and high vacuum conditions, such as during engine starting, for example. Otherwise, the intake vacuum acting with exhaust back pressure may be sufficient to move dual pintle 200 against biasing device 210' to allow some undesirable EGR flow under low load and high vacuum conditions.

As also shown in FIG. 3, valve 130' includes a first calibration device 250 associated with biasing device 210' and a second calibration device 252 associated with biasing device 262. The calibration devices may be used to adjust or calibrate the force required to open/close openings using pintles 200, 260. In the representative embodiments illustrated, calibration devices 250, 252 are implemented by screws that modify the spring pre-load of corresponding coil springs.

FIG. 4 is a graph illustrating a representative operating range of a pintle-type EGR valve to provide external EGR under mid-to-high loads and stop EGR at WOT conditions according to embodiments of the present disclosure. As represented by the graph of FIG. 4, a mechanical pintle-type EGR valve provides EGR flow for mid-to-high load operating conditions represented by area 300. External EGR flow is blocked in high vacuum and low load operating conditions represented by areas 304 and 310, as well as at WOT as represented by region 308. In the representative application illustrated, differential exhaust pressure must exceed a first threshold of about fifteen inches of mercury (15" HG) for external EGR flow where the differential or delta pressure is defined as the difference between the exhaust back pressure and the manifold pressure. EGR flow is blocked when the differential pressure exceeds a second threshold corresponding to WOT operation, which varies from about 27" HG at about 1400 RPM to about 16" HG at about 3000 RPM.

As such, various embodiments of the present disclosure as described above provide a relatively simple and cost effective strategy for improving fuel economy and managing emissions. In particular, a pintle-type EGR valve consistent with the present disclosure operates based on exhaust pressure differential rather than in response to a signal from the engine/vehicle controller to open and meter EGR flow for mid-to-high loads while closing to stop EGR flow under low-load conditions and also at WOT. The addition of external EGR with a pintle-type mechanical EGR valve may improve knock/pre-ignition robustness to enhance performance and fuel economy while effectively managing emissions, particularly for implementations having limited control of internal EGR under various operating conditions. Use of a pintle-type valve without a diaphragm eliminates diaphragm-related temperature constraints such that the EGR valve can be mounted directly to the exhaust manifold, thereby eliminating any connecting tube or pipe between the exhaust manifold and the valve. The use of a pressure-controlled mechanical valve does not require additional engine control software programming and calibration, while still providing desired control characteristics to prevent EGR flow during engine starting, low-load operation, and WOT operation.

As illustrated in FIGS. 1-4, a method for controlling an internal combustion engine having an exhaust gas recirculation valve according to the present disclosure includes biasing a pintle 200 against a chamber entrance 184 to prevent exhaust gas flow to an intake until exhaust differential pressure exceeds a first threshold 300 and moving the pintle 200 against the biasing force of spring 210 to close a chamber exit 188 and prevent exhaust gas flow to the intake when exhaust differential pressure exceeds a second threshold 308 greater than the first threshold. Where the EGR valve includes a dual pintle, the method may include sealing the chamber entrance 184 with a first surface 208 when the exhaust differential pressure is below the first threshold and sealing the chamber exit 188 with a second surface 204 when the differential pressure exceeds the second threshold. In one embodiment with a valve having a second or supplementary pintle 260, the method may include moving the second pintle 260 against an associated spring 262 to close a second chamber exit 192' to prevent exhaust gas flow to the intake when intake vacuum exceeds a corresponding threshold and biasing the second pintle 260 away from a second chamber exit 194' to allow exhaust gas flow to the intake when intake vacuum is below a corresponding threshold.

While the best mode has been described in detail, those familiar with the art will recognize various alternative designs and embodiments within the scope of the following claims. Where one or more embodiments have been described as providing advantages or being preferred over other embodiments and/or over prior art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not necessarily outside the scope of the following claims.

What is claimed:

1. A system for controlling exhaust gas recirculation in a multiple cylinder internal combustion engine, the system comprising:

a variable cam timing device in communication with a microprocessor-based controller for altering timing of gas exchange valves to control internal exhaust gas recirculation; and a mechanical exhaust gas recirculation valve not controlled by the microprocessor-based controller, the valve disposed between an engine exhaust and an engine intake and including a pintle having first and second surface areas sized to generate a valve-opening force when an exhaust pressure differential exceeds a first threshold to allow exhaust gas to flow from the exhaust to the intake and to generate a valve-closing force when an exhaust pressure differential exceeds a second threshold to substantially stop exhaust gas flow from the exhaust to the intake.

2. The system of claim 1 wherein the valve does not have a diaphragm to facilitate direct mounting of the valve to an engine exhaust manifold.

3. The system of claim 1 wherein the valve is mounted directly to an engine exhaust manifold.

4. The system of claim 1 wherein the valve comprises:

a dual pintle including a first valve land having the first surface area and sealing against a first valve chamber entrance to block exhaust gas flow to the intake until the exhaust pressure differential exceeds the first threshold and a second valve land spaced from the first valve land and having the second surface area sealing against a first valve chamber exit to block exhaust gas flow to the intake when the exhaust pressure differential exceeds the second threshold.

5. The system of claim 4 wherein the valve further comprises:

a spring disposed to bias the dual pintle toward the chamber entrance and away from the chamber exit.

6. The system of claim 5 wherein the valve further comprises:

a calibration device acting on the spring to adjust at least one of the first and second thresholds.

7. The system of claim 6 wherein the calibration device changes the spring pre-load.

8. The system of claim 4 wherein the valve further comprises:

a second pintle selectively sealing against a second valve chamber exit to block exhaust gas flow to the intake when the exhaust pressure differential is below a corresponding threshold.

9. The system of claim 8 wherein the valve further comprises:

a second spring biasing the second pintle in an open position away from the second valve chamber exit.

10. The system of claim 9 wherein the valve further comprises:

a calibration device acting on the second spring to adjust pre-load of the second spring.

11. The system of claim 9 wherein the second valve chamber exit is coupled to the engine intake such that intake vacuum acts on the second pintle against the second spring to selectively move the second pintle to a closed position against the second valve chamber exit.

12. A method for controlling an internal combustion engine having an exhaust gas recirculation valve, the method comprising:

biasing a pintle against a chamber entrance to prevent exhaust gas flow to an intake until exhaust differential pressure exceeds a first threshold; and moving the pintle against the biasing force to close a chamber exit and prevent exhaust gas flow to the intake when exhaust differential pressure exceeds a second threshold greater than the first threshold.

13. The method of claim 12 wherein the pintle comprises a dual pintle having a first surface sealing against the chamber entrance when the exhaust differential pressure is below the first threshold and a second surface sealing against the chamber exit when the differential pressure exceeds the second threshold.

14. The method of claim 12 further comprising:

moving a second pintle against an associated spring to close a second chamber exit to prevent exhaust gas flow to the intake when exhaust pressure differential exceeds a corresponding threshold.

15. The method of claim 12 further comprising:

biasing a second pintle away from a second chamber exit to allow exhaust gas flow to the intake when intake vacuum is below a corresponding threshold.

16. A system for controlling exhaust gas recirculation in a multiple cylinder internal combustion engine using a flow control valve comprising:

a housing having a first chamber with an entrance for coupling to an exhaust manifold of the engine and an exit coupled to a second chamber with a second chamber exit coupled to a valve exit;

a dual pintle moving within the first chamber between a first position with a first surface sealing against the first chamber entrance to block exhaust flow from entering the first chamber, a second position with the first surface spaced from the first chamber entrance and a second surface spaced from the first chamber exit to allow exhaust flow through the first chamber entrance and exit, and a third position with the second surface sealing against a first chamber exit to prevent exhaust flow from leaving the first chamber; and a biasing device contacting the dual pintle to bias the first surface of the dual pintle toward the first chamber entrance.

17. The system of claim 16 further comprising:

a second pintle moving within the second chamber between a first position with a first surface sealing against the second chamber exit to block exhaust flow from passing to the valve exit and a second position with the first surface spaced from the second chamber exit to allow exhaust flow to pass to the valve exit.

18. The system of claim 17 further comprising:

a biasing device contacting the second pintle to bias the first surface of the second pintle away from the second chamber exit.

19. The system of claim 16 wherein the biasing device comprises a spring disposed between the housing and the dual pintle.

20. The system of claim 19 further comprising a calibration device in contact with the biasing device to calibrate the force required to move the first surface of the dual pintle away from the first chamber entrance.

* * * * *